US009080393B2

(12) United States Patent
Wishahy

(10) Patent No.: US 9,080,393 B2
(45) Date of Patent: Jul. 14, 2015

(54) DRILLING RISER RETRIEVAL IN HIGH CURRENT

(71) Applicant: Transocean Sedco Forex Ventures Limited, Houston, TX (US)

(72) Inventor: Momen A. Wishahy, Katy, TX (US)

(73) Assignee: Transocean Sedco Forex Ventures Limited, George Town Grand Cayman (KY)

( * ) Notice: Subject to any disclaimer, the term of this patent is extended or adjusted under 35 U.S.C. 154(b) by 203 days.

(21) Appl. No.: 13/843,685

(22) Filed: Mar. 15, 2013

(65) Prior Publication Data

US 2013/0319680 A1 Dec. 5, 2013

Related U.S. Application Data

(60) Provisional application No. 61/653,480, filed on May 31, 2012.

(51) Int. Cl.
*E21B 7/12* (2006.01)
*E21B 17/01* (2006.01)

(52) U.S. Cl.
CPC ..... *E21B 17/01* (2013.01)

(58) Field of Classification Search
CPC ..... E21B 19/004
USPC ..... 166/340, 359, 365; 405/158
See application file for complete search history.

(56) References Cited

U.S. PATENT DOCUMENTS 4,147,221 A 4/1979 Ilfrey et al.
4,205,379 A * 5/1980 Fox et al. ..... 701/116
4,317,174 A * 2/1982 Dean ..... 701/116
4,576,516 A * 3/1986 Denison ..... 405/224.4
5,046,896 A 9/1991 Cole
5,615,977 A * 4/1997 Moses et al. ..... 405/195.1
5,676,209 A * 10/1997 Reynolds ..... 166/345
5,823,131 A 10/1998 Boatman et al.
6,009,825 A 1/2000 Fulton et al.
6,343,655 B1 * 2/2002 Thomas ..... 166/343
7,080,689 B2 * 7/2006 Guesnon et al. ..... 166/355
7,416,025 B2 * 8/2008 Bhat et al. ..... 166/355
7,712,539 B2 * 5/2010 Einar ..... 166/355
8,152,580 B2 * 4/2012 Straume et al. ..... 441/4

(Continued)

OTHER PUBLICATIONS

International Search Report and Written Opinion mailed Sep. 30, 2013, during examination of International Application No. PCT/US2013/041438.

*Primary Examiner* — Matthew Buck
*Assistant Examiner* — Aaron Lembo
(74) *Attorney, Agent, or Firm* — Norton Rose Fulbright US LLP

(57) ABSTRACT

The disclosure is directed to a method for retrieving a drilling riser connected to a blow-out-preventer (BOP) located on a sea bed. The method includes the steps of: a) attaching the first end of the retrieval line to a vessel; b) attaching the second end of the retrieval line to a drilling riser; c) disconnecting the riser from the BOP; d) initiating the assent of the disconnected riser from the sea bed; e) maintaining tension on the riser as it ascends to the sea surface by creating a horizontal load that is opposite to a current load on a bottom end of the riser; f) releasing tension on the retrieval line as the riser approaches the bottom of the drilling vessel; and/or g) disconnecting the retrieval line from the riser, whereby the riser is pulled through the bottom opening in the drilling vessel.

9 Claims, 13 Drawing Sheets

(56) References Cited

U.S. PATENT DOCUMENTS

| | | | | |
|---|---|---|---|---|
| 8,708,052 | B2 * | 4/2014 | Radi | 166/350 |
| 2008/0223583 | A1 | 9/2008 | Roveri et al. | |
| 2008/0314598 | A1 * | 12/2008 | Rodrigues et al. | 166/342 |
| 2011/0290499 | A1 | 12/2011 | Petegem et al. | |
| 2012/0037376 | A1 | 2/2012 | Le Moign et al. | |

* cited by examiner

DRILLING RISER RETRIEVAL IN HIGH CURRENT

CROSS-REFERENCE TO RELATED APPLICATIONS

This application claims priority to U.S. Provisional Application No. 61/653,480 to Momen A. Wishahy entitled "Drilling Riser Retrieval in High Current" and filed on May 31, 2012, which is hereby incorporated by reference in its entirety.

TECHNICAL FIELD

The disclosure is directed to offshore drilling operations and, more specifically, to a method for retrieving a drilling riser from the sea bed in high current.

BACKGROUND

In offshore drilling systems, a riser extends from the blow-out preventers (BOPs) at the ocean floor to the drilling vessel floating on the ocean surface. In the presence of high current conditions, riser retrieval may not be possible. When there is a storm, such as a hurricane, that approaches the drilling site, the vessel motions in the waves are excessive and it is necessary for the drilling vessel to disconnect from the well and retrieve the riser on board. Failing to retrieve the riser, the riser joints may be damaged or the entire string dropped to sea causing significant vessel down time and financial loss to replace the lost equipment. Conventionally, the riser is disconnected at the ocean floor, and the entire riser must be retrieved and laid down in joints on the floating vessel. It is not uncommon in locations such as the Gulf of Mexico for a drilling ship to have to disconnect several times because of approaching storms during a typical hurricane season. A problem associated with the retrieval of a riser from the water in high currents is that after the riser disconnect from the sea bed, the riser experiences a relatively large top angle under the action of current load on the riser. This angle causes the riser joints to jam in the diverter housing. Pulling the riser while it is leaning on the diverter will damage the joints and the buoyancy modules. Thus, retrieval of the riser may not be possible by the conventional approach.

It would be advantageous to provide a method that would allow for retrieval of the drilling riser in high currents and extreme weather conditions without substantial modifications to the drill floor and vessel equipment.

BRIEF SUMMARY

According to one embodiment, a method may retrieve a drilling riser connected to a blow-out-preventer (BOP) located on a sea bed. A retrieval line may be used having first and second ends and the drilling riser is connected to a moored and/or dynamically positioned drilling vessel having a bottom opening.

The method may include the steps of: a) attaching the first end of the retrieval line to a vessel; b) attaching the second end of the retrieval line to a drilling riser; c) disconnecting the riser from the BOP; d) initiating the assent of the disconnected riser from the sea bed; e) maintaining tension on the riser as it ascends to the sea surface by creating a horizontal load that is opposite to a current load on a bottom end of the riser; f) releasing tension on the retrieval line as the riser approaches the bottom of the drilling vessel; and/or g) disconnecting the retrieval line from the riser, whereby the riser is pulled through the bottom opening in the drilling vessel.

The riser can be disconnected from the BOP prior to attaching the second end of the retrieval line to the drilling riser.

The retrieval line may include a first buoyant object connected to a first end of a wire, a second end of the wire connected to a first end of a weighted length of material, a second end of the weighted length of material connected to a first end of a rope, a second end of the rope configured to connect to the drilling riser, and a second buoyant object attached to a mid-point of the rope.

The method may further include the vessel retrieving the first buoy floating on the surface of the sea while the riser is still connected to the BOP. The method also include moving the drilling vessel to straighten the riser in the bottom of the drilling vessel prior to initiating the assent of the disconnected riser from the sea bed.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION

Figure 1:
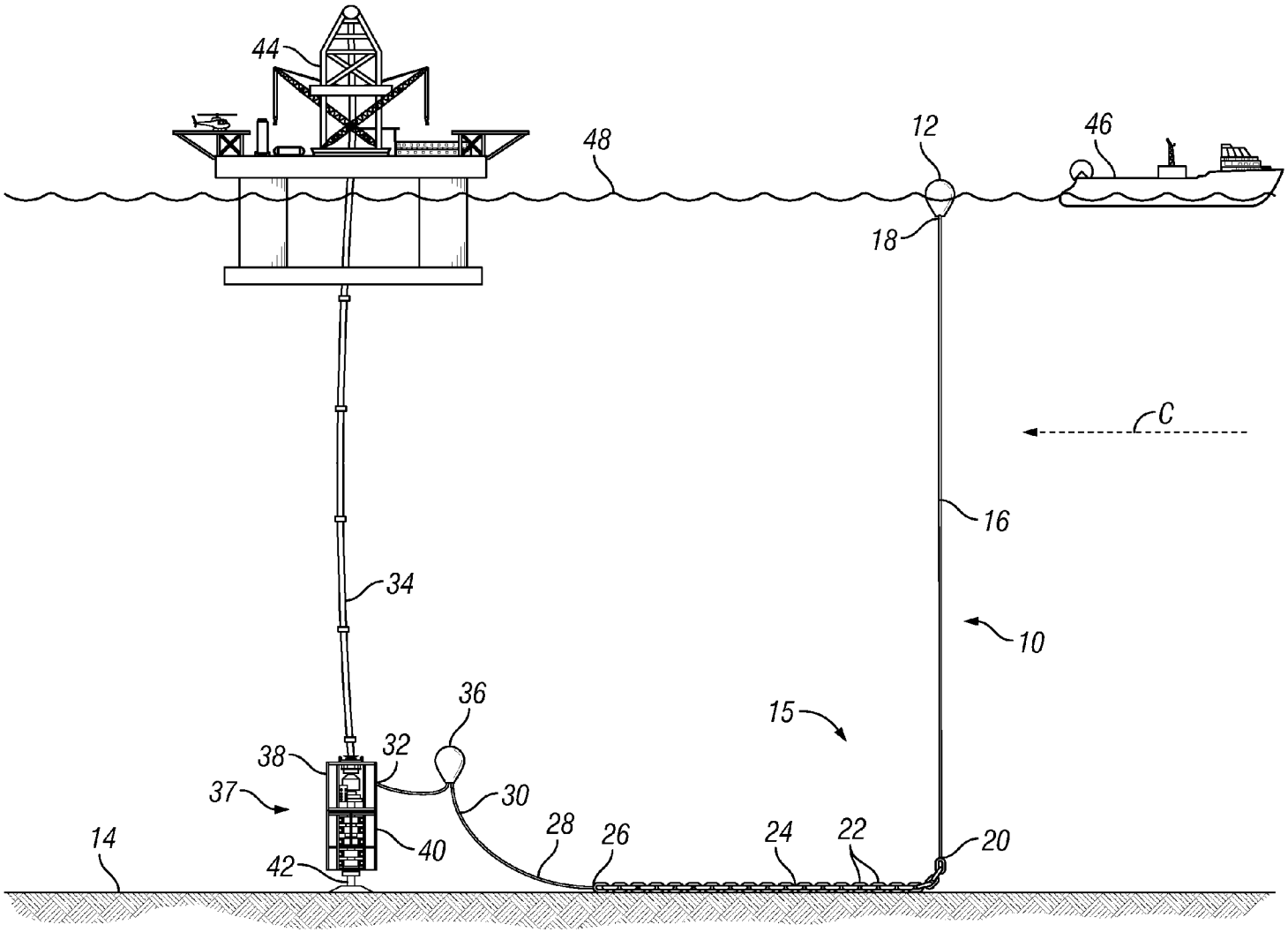
FIG. 1 is an illustration of a drilling vessel in which the first buoy is floating on the surface of the sea according to one embodiment of the disclosure.
Figure 2:
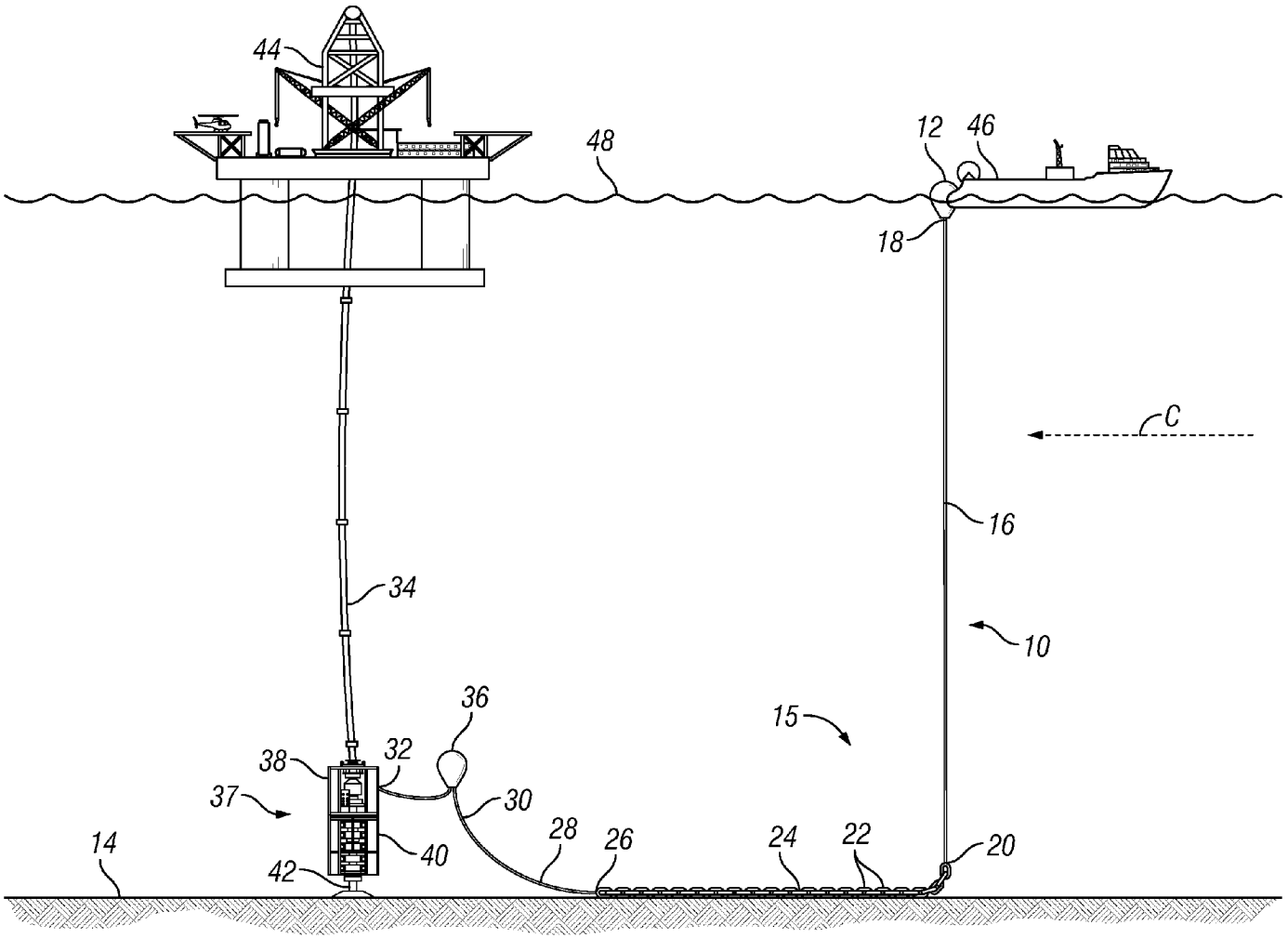
FIG. 2 is an illustration of the anchor handling vessel retrieving the first buoy while the riser and LMRP are still latched to the BOP stack according to one embodiment of the disclosure.

Riser retrieval may be performed in high current into a drilling vessel. A drilling riser is a pipe that transports mud and cuttings from the wellhead on the seafloor to the drilling vessel on the surface. After the riser is disconnected from the blow-out preventer stack at the sea bed in high current, the riser develops a relatively large top angle due to the action of the high current loads. This angle causes the riser joints to jam in the diverter housing in the drilling vessel. Pulling the riser while it is leaning on the diverter will damage the riser joints and the buoyancy modules. Thus, retrieval of the riser may not be possible.

The method disclosed here may allow retrieving a drilling riser into a drilling vessel from the sea bed in high currents C or extreme weather. The method is based, in part, on applying a horizontal load (with a small vertical load component) opposite to the current loads to the bottom of the riser when the riser is at the sea bed. This straightens the top angle of the riser without stressing the riser joints. Thus, centralizing the riser in the diverter housing/rotary table will allow for its retrieval from the sea bed.

The retrieval system 10 as shown in FIGS. 1-13 may include a first buoy 12 on the water line 48 connected to a wire 16 (preferable steel wire) at a first end 18 that extends to or near the sea bed 14, a second end 20 of the wire 16 is connected to a first end 22 of a length of chain 24. The second end 26 of the chain 24 is connected to a first end 28 of a rope 30 (preferably fiber) and the second end 32 of the rope 30 is connected to the riser 34 by means of a bridle, remote activated disconnect device or some other connection known to one skilled in the art. The combination of the wire 16, chain 24 and rope 30 comprise the retrieval line 15. Midway between the first 28 and second 32 end of the rope 30 is a second buoy 36. The riser 34 at the sea bed 14 is connected to the blow-out-preventer stack 37 which is composed of two parts. The top part is a lower marine riser package ("LMRP") 38 and the lower part is the BOP 40. The BOP 40 sits on top of the wellhead and is connected to the casings below through the wellhead connector 42. At the end of the well drilling program, the riser 34 is disconnected at the sea bed 14 above the wellhead connector 42 and the riser 34 and the BOP 40 are retrieved on board the drilling vessel 44. Alternatively, the riser 34 may be disconnected at the LMRP 38 level, as needed, at any stage of the well drilling program. In this case the BOP 40 is left connected to the wellhead connector 42 to provide the required barriers to the wellbore as required by regulations. The chain 24 can be replaced with an anchor or clump weight. The type of the wires 28 and 16 are determined based on sea bed installation and required loads.

The system may be deployed away from the drilling vessel 44 in a safe zone. The DP drilling vessel 44 can move towards the retrieval system 10 with the riser 34 in the water, connected to the BOP stack 37. The riser 34 is then connected to the retrieval system 10. For moored and dynamically positioned ("DP") vessels, the retrieval system 10 may be connected while the riser 34 is connected to BOP stack 37 at the seabed 14, or after the riser 34 is disconnected from the BOP stack 37 depending on subsea installations. The retrieval line 15 is connected to the riser 34 using a remotely operated underwater vehicle ("ROV"). The applied bottom loads are controlled by the line tension and the surface boat, such as an anchor handling vessel ("AHV") 46. A remote activated disconnect device is attached to the lines to disconnect the riser near sea surface. The current flow C is shown in the figures as an arrow with a dotted line.

Figure 3:
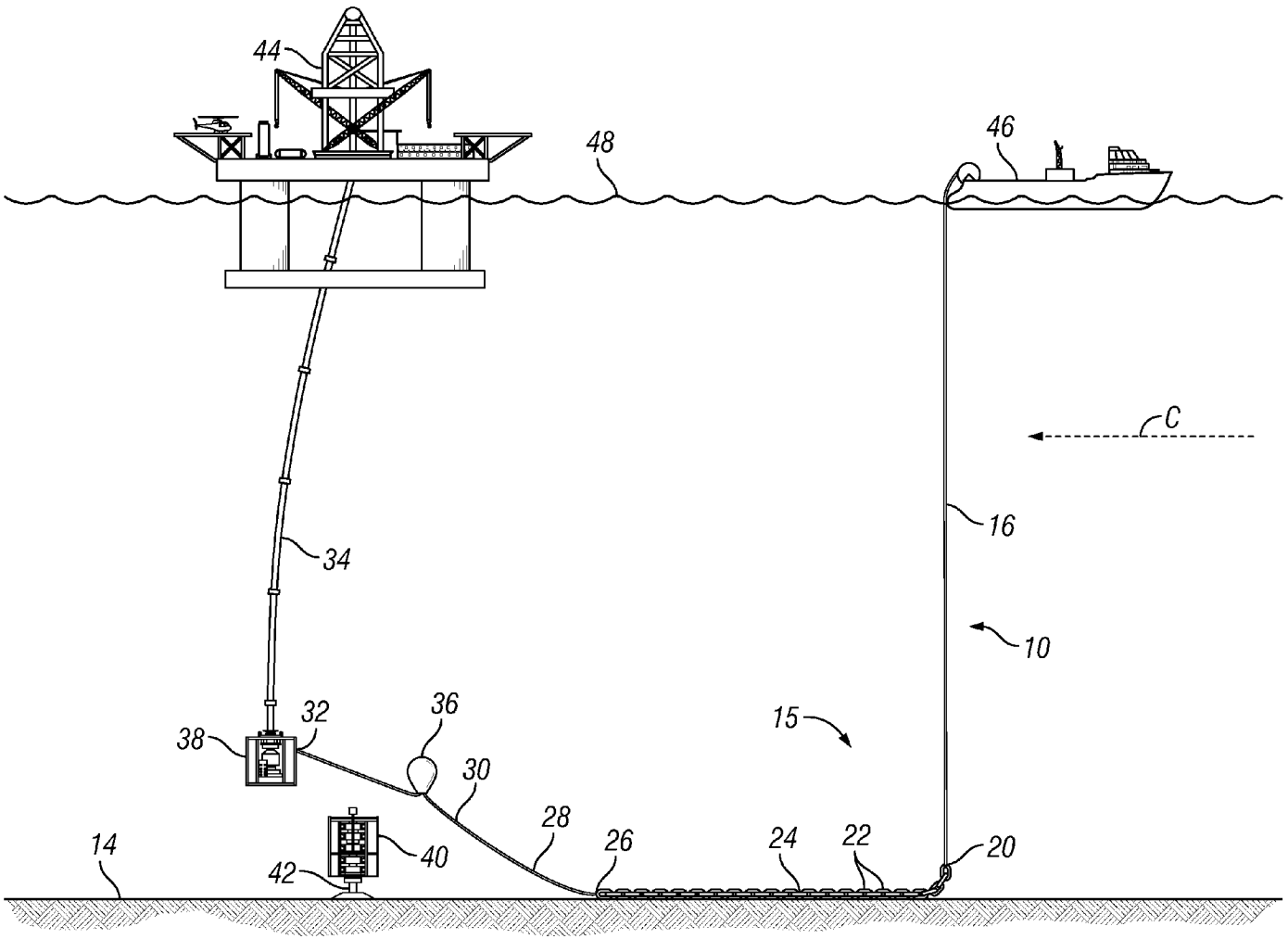
FIG. 3 is an illustration of the riser and LMRP are being unlatched from the BOP stack and floating with the current according to one embodiment of the disclosure.
Figure 4:
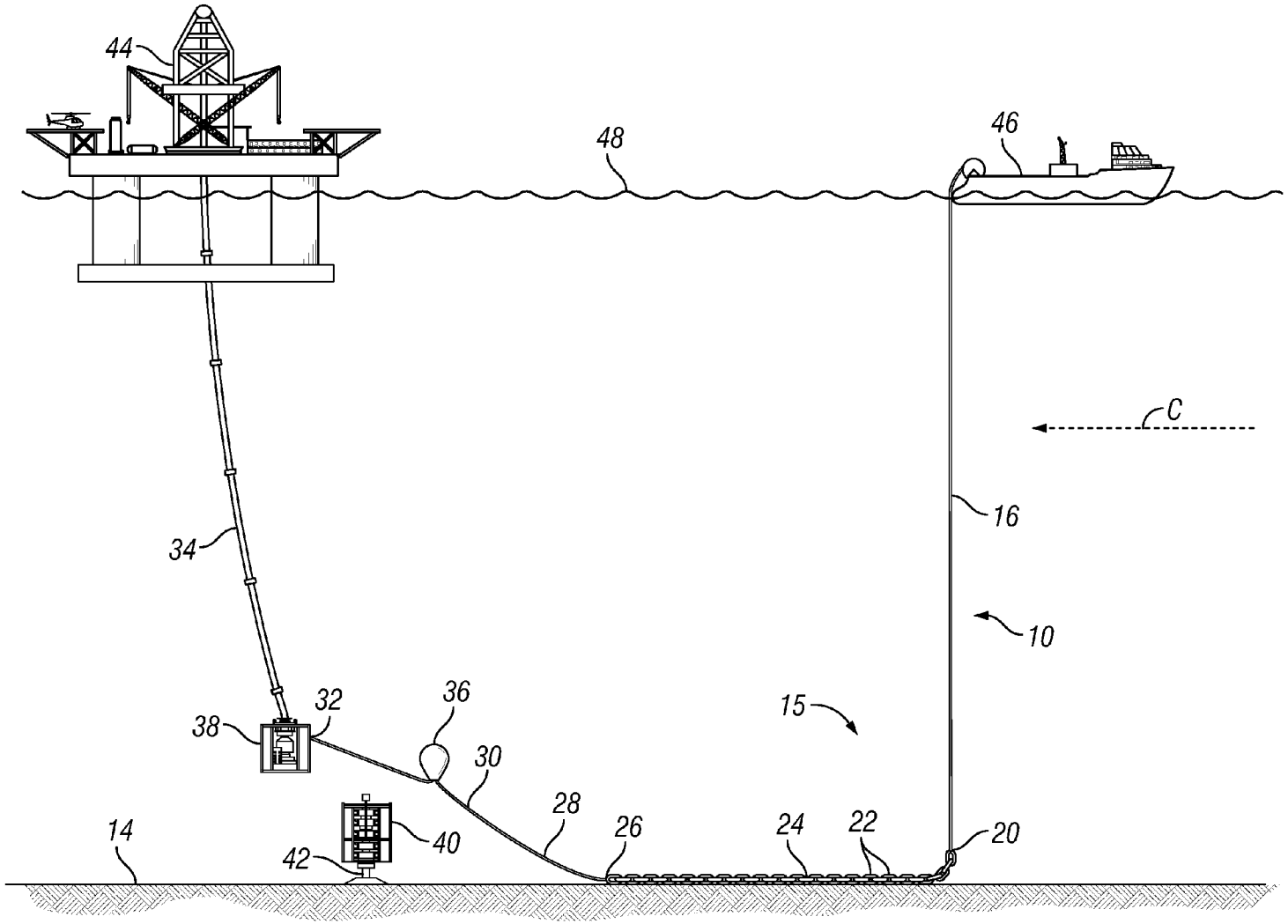
FIG. 4 is an illustration of the drilling vessel moving to straighten the riser in the moon pool and to begin retrieving the riser according to one embodiment of the disclosure.
Figure 5:
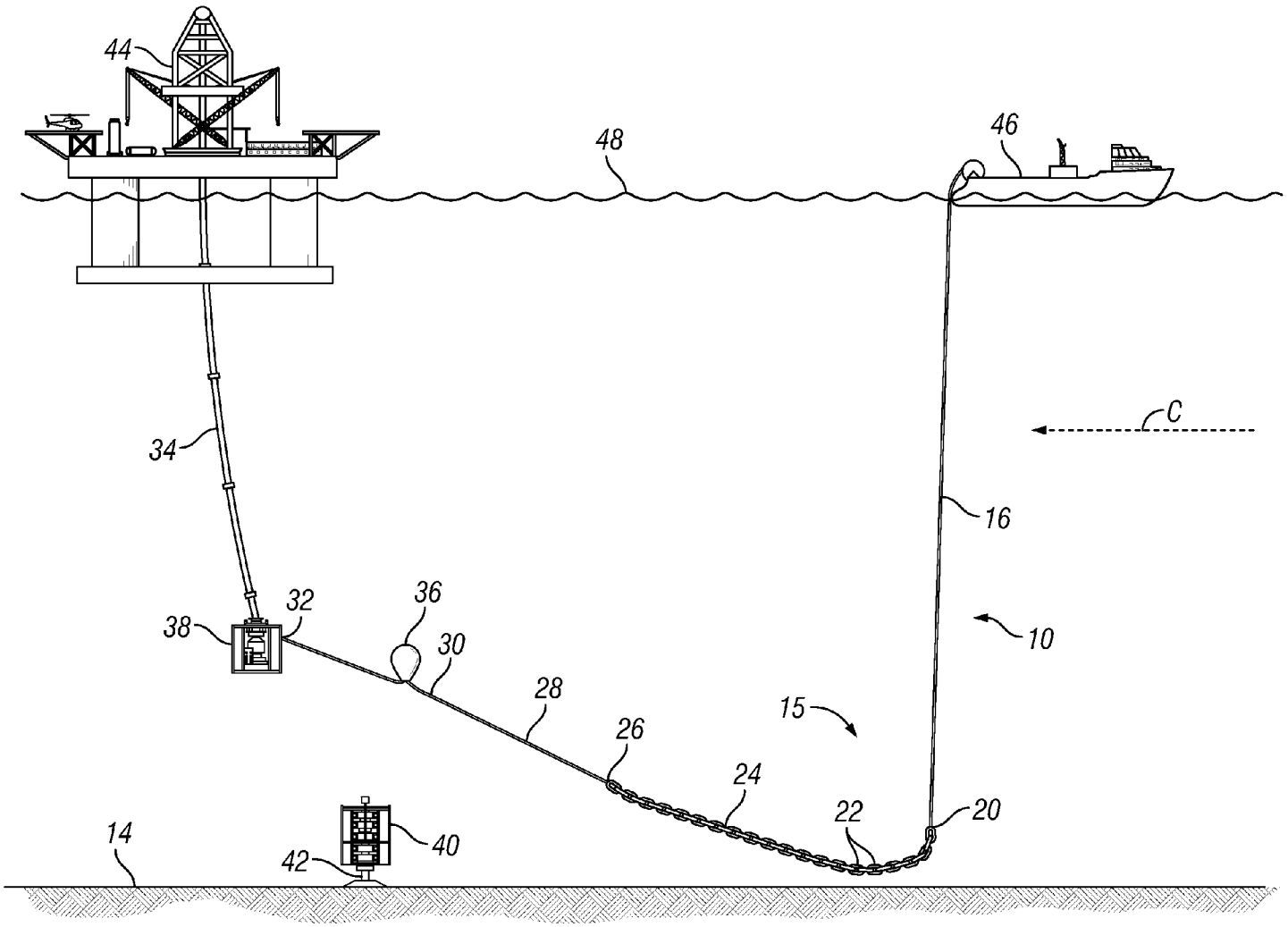
FIG. 5 is an illustration of the anchor handling vessel maintaining tension on the riser as it is being retrieved up to the drilling vessel according to one embodiment of the disclosure.
Figure 6:
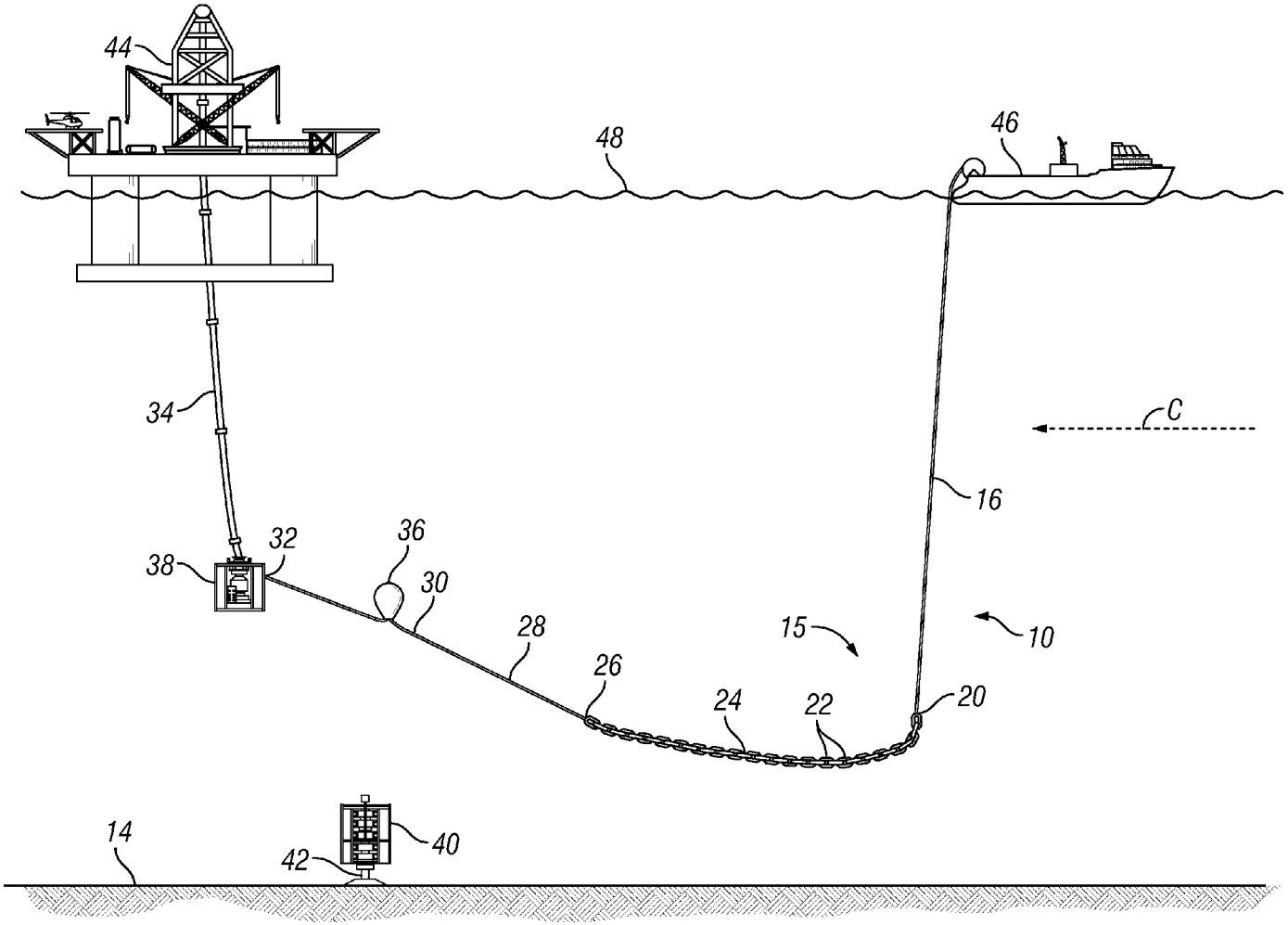
FIG. 6 is an illustration of the weight of the chain adding horizontal force and vertical tension to the riser as it is being retrieved up to the drilling vessel according to one embodiment of the disclosure.
Figure 7:
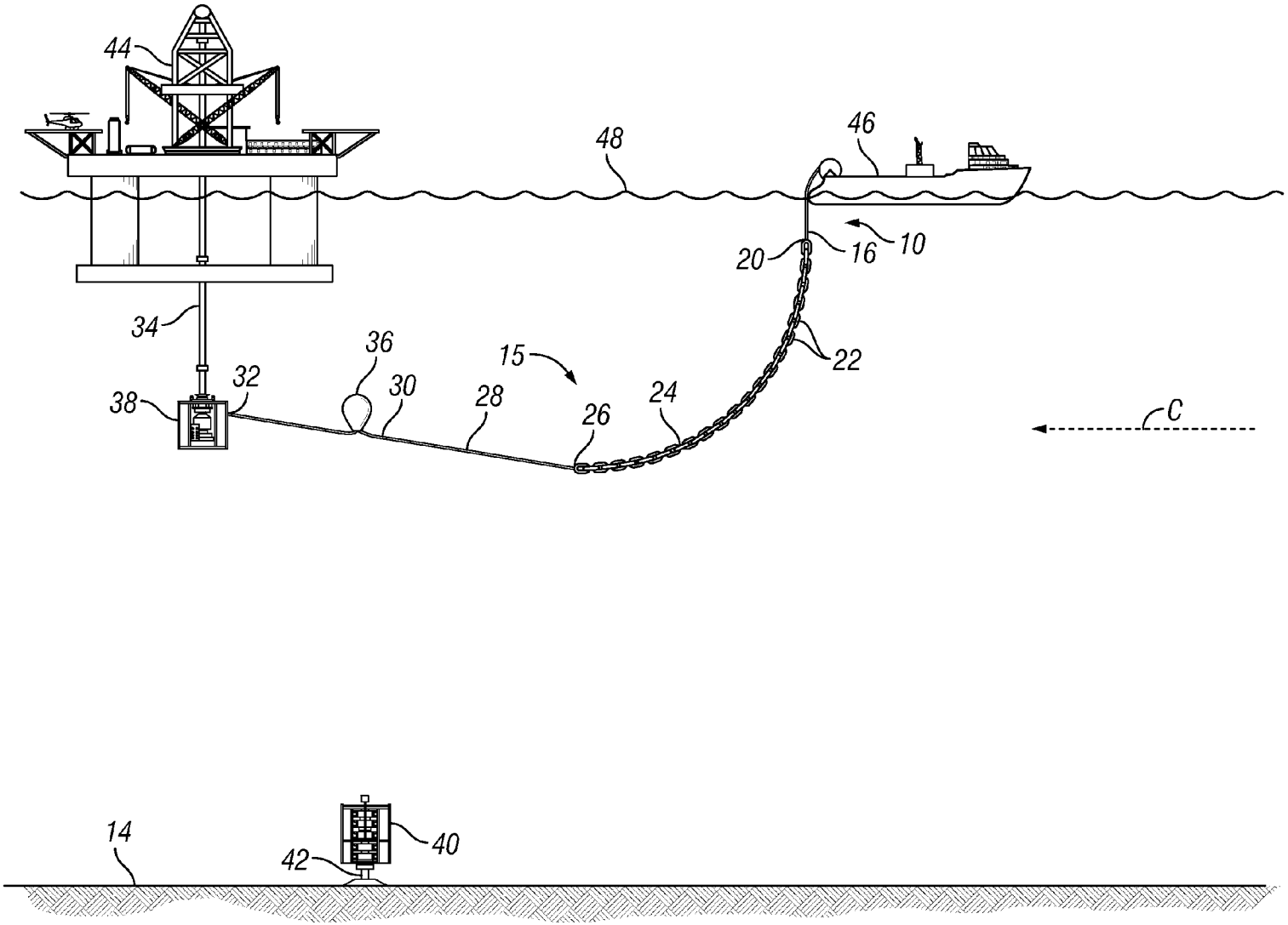
FIG. 7 is an illustration of the weight of the chain centralizing the riser in the diverter housing and maintaining tension on the riser as it is being retrieved up to the drilling vessel according to one embodiment of the disclosure.
Figure 8:
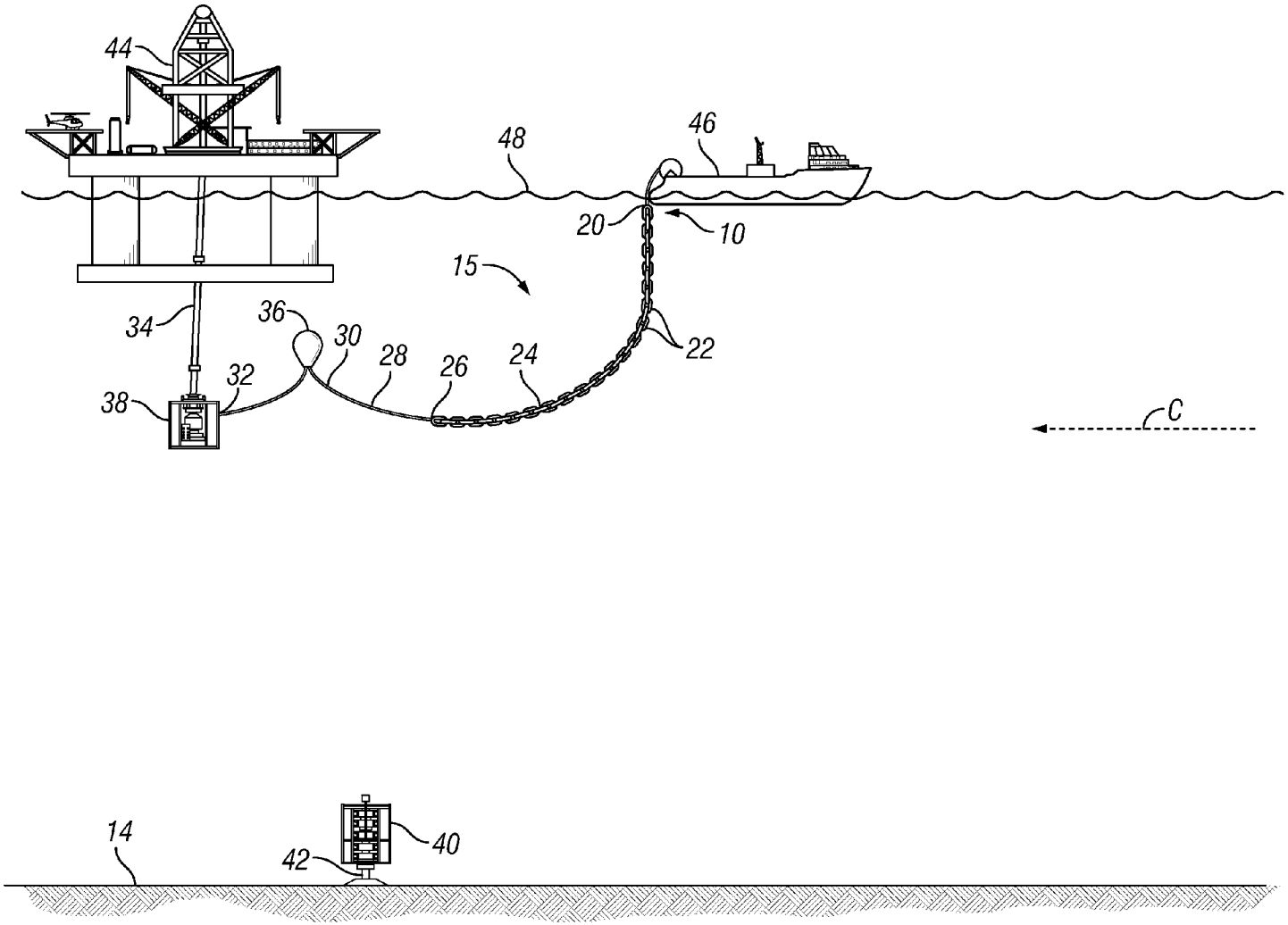
FIG. 8 is an illustration of the tension on the riser being released by the anchor handling vessel as the riser nears the drilling vessel according to one embodiment of the disclosure.
Figure 9:
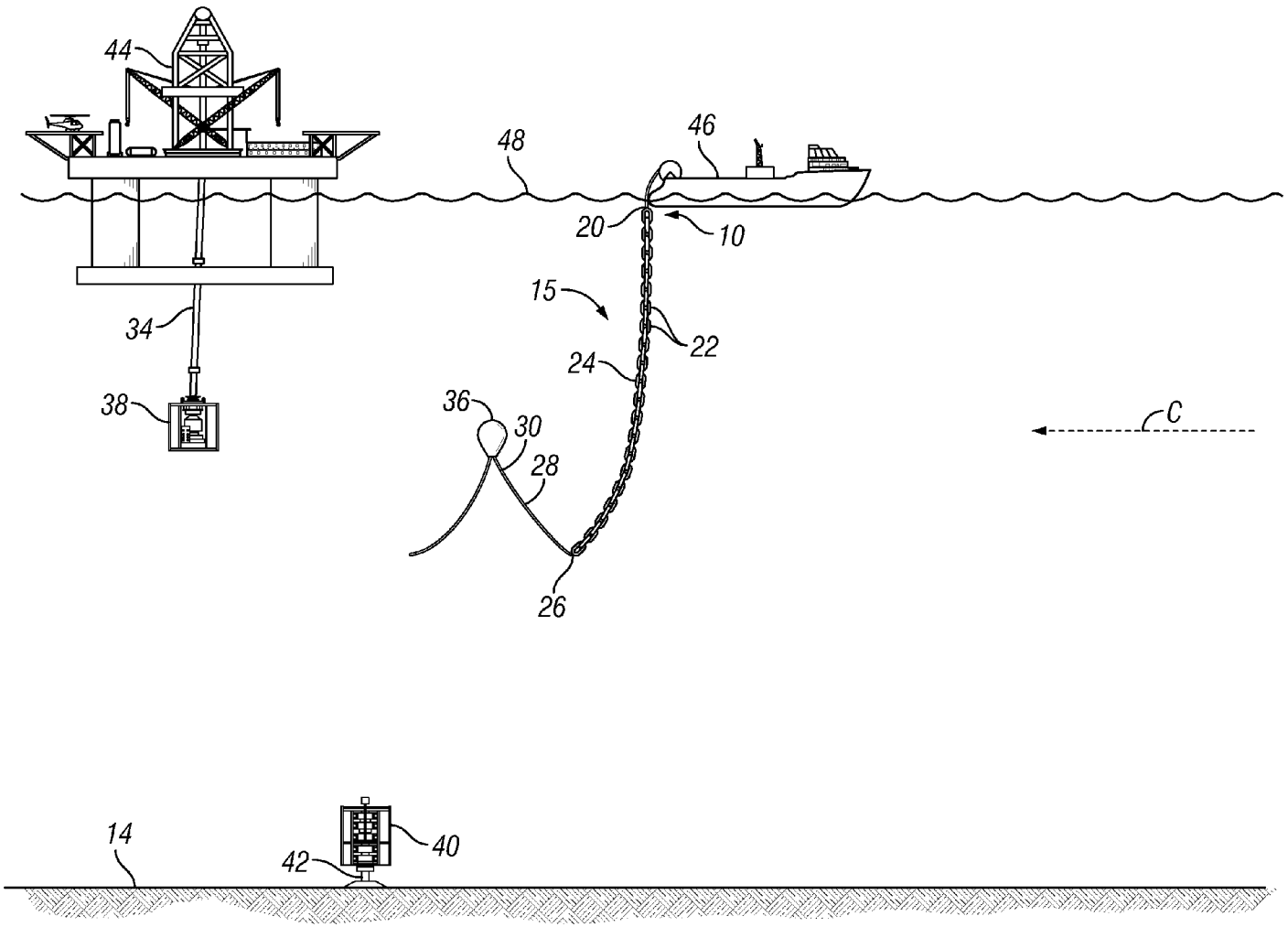
FIG. 9 is an illustration of the line being remotely disconnected from the riser according to one embodiment of the disclosure.
Figure 10:
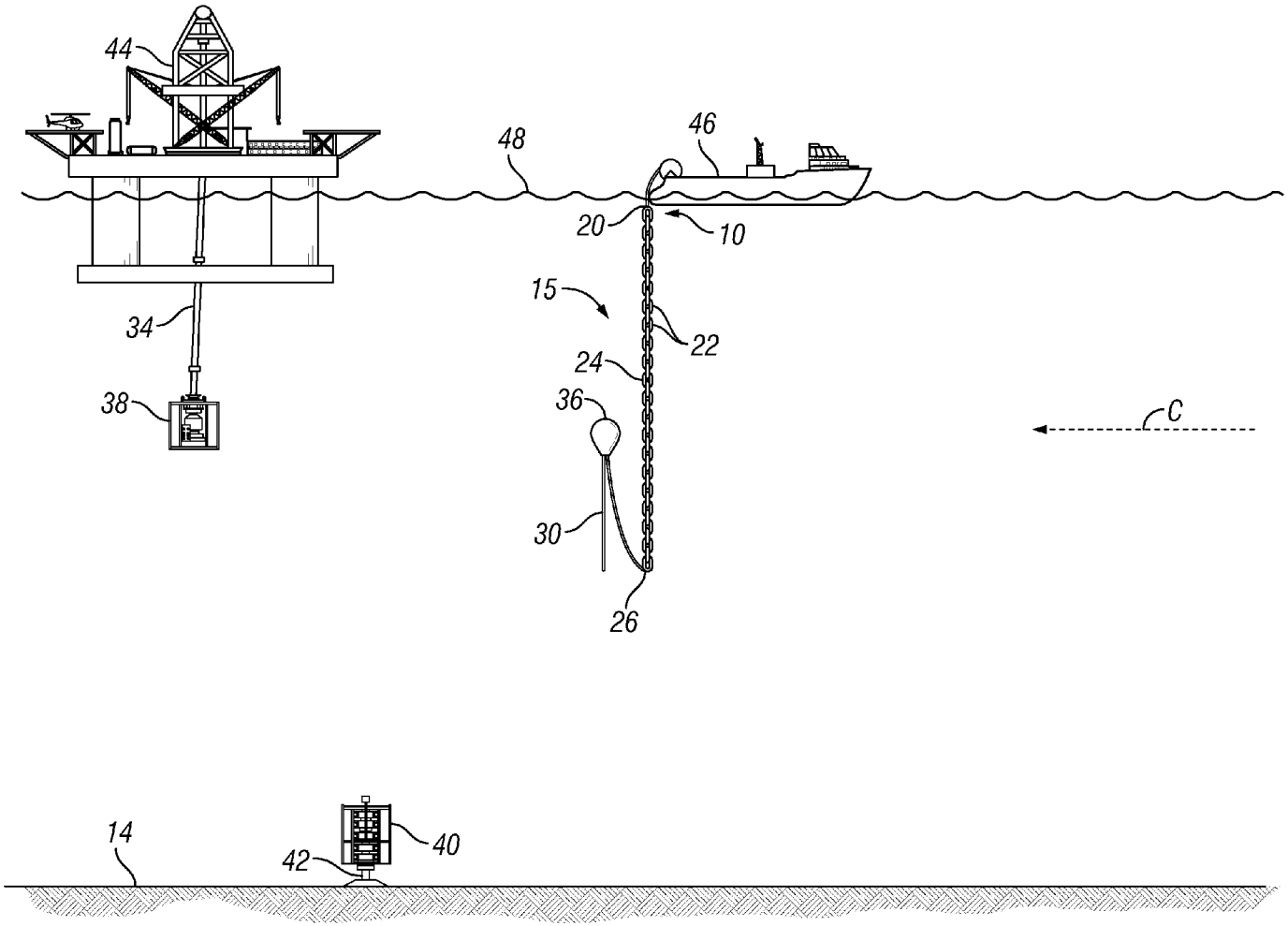
FIG. 10 is an illustration of the slack line and second buoy moving toward the anchor handling vessel according to one embodiment of the disclosure.
Figure 11:
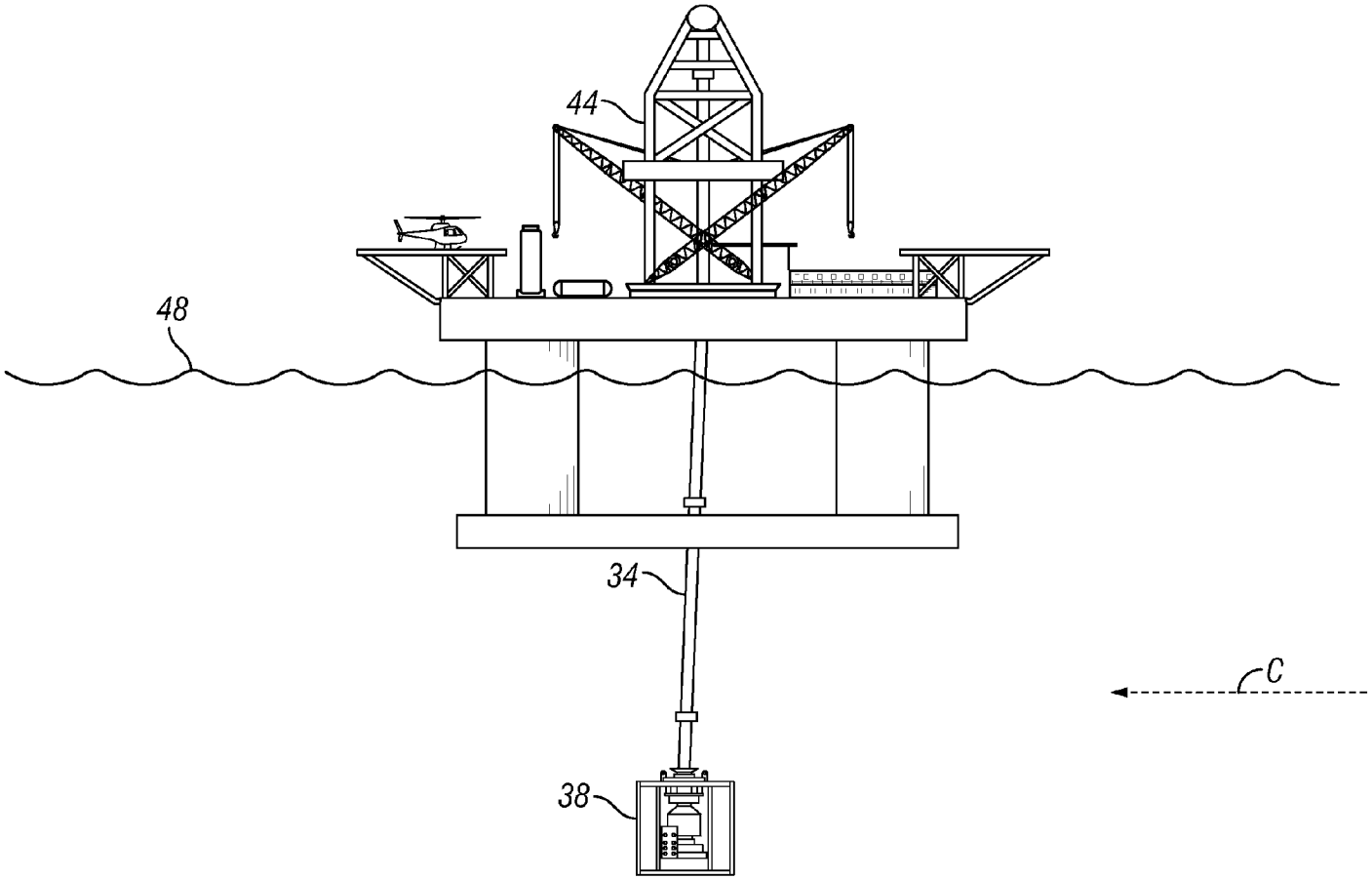
FIG. 11 is an illustration of the rig drifting to straighten the riser in the moon pool according to one embodiment of the disclosure.
Figure 12:
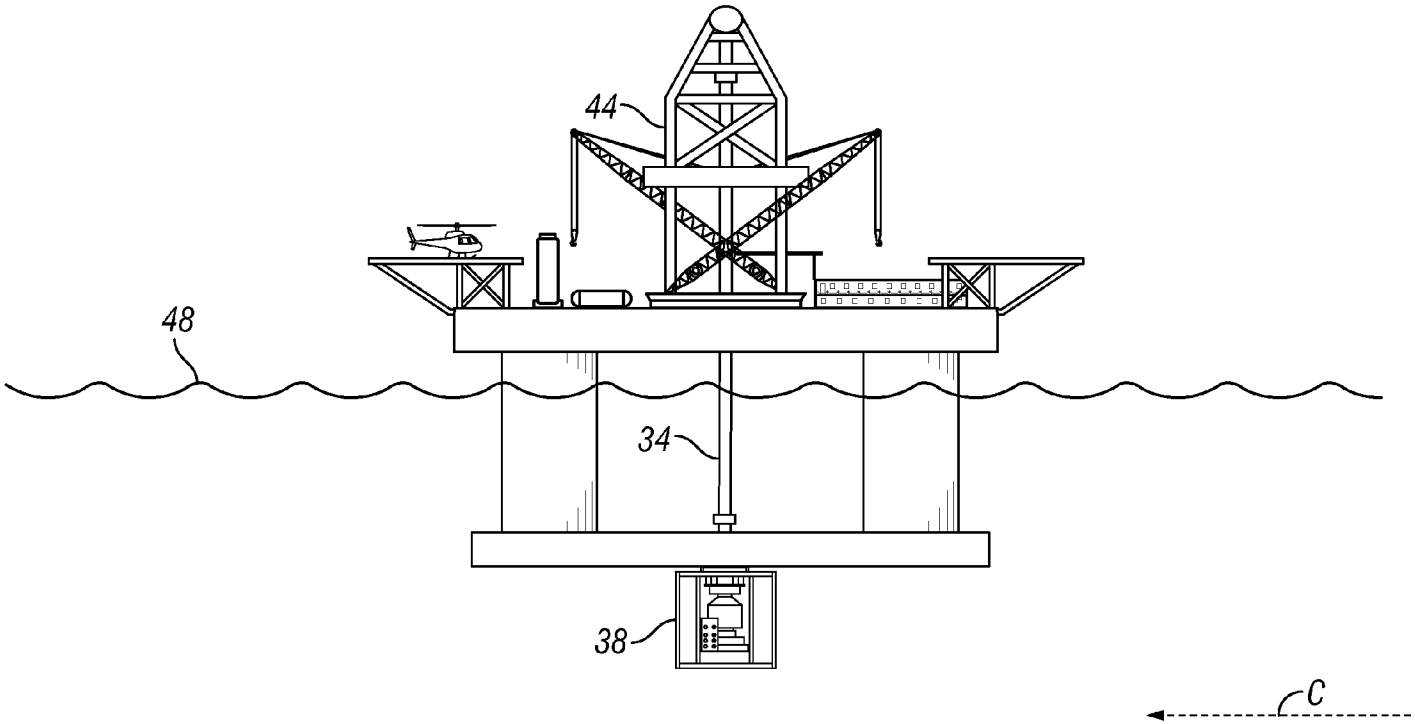
FIG. 12 is an illustration of the riser and LMRP being retrieved into the drilling vessel according to one embodiment of the disclosure.
Figure 13:
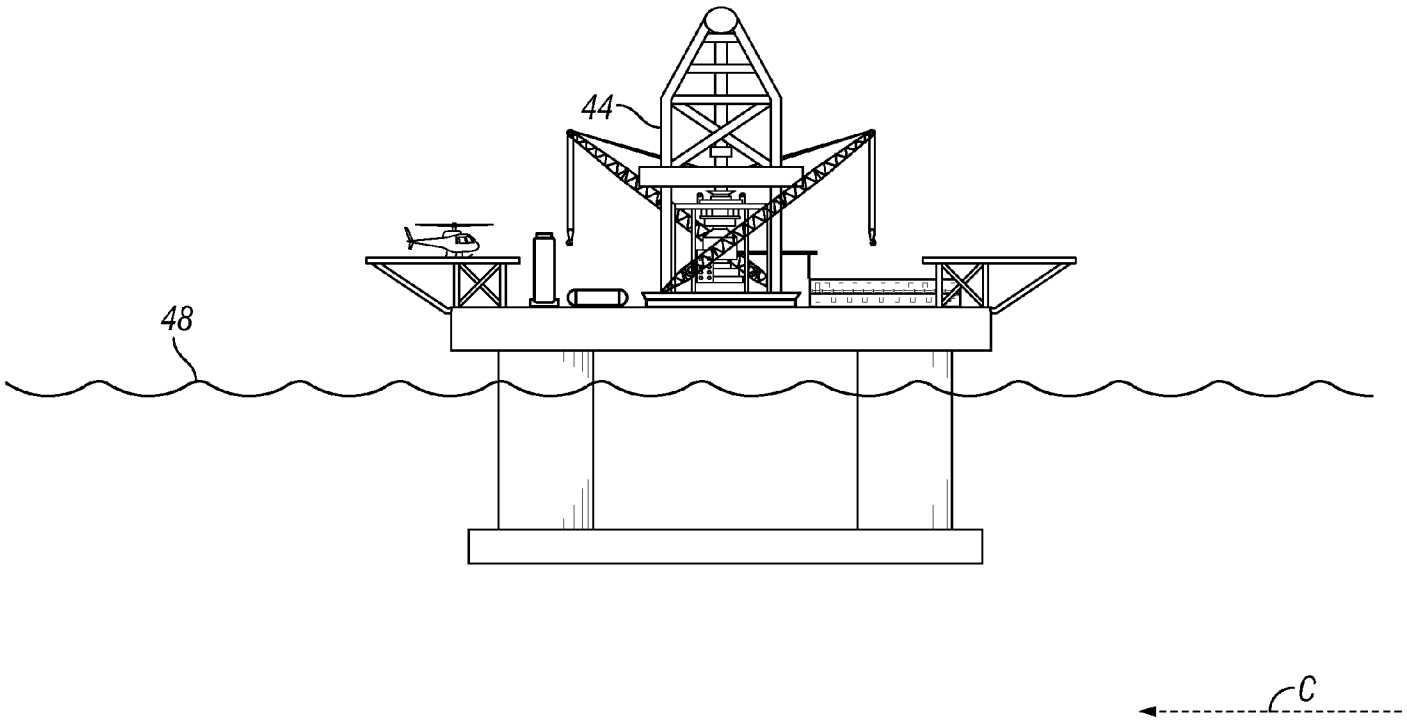
FIG. 13 is an illustration of the riser and LMRP completely retrieved into the drilling vessel according to one embodiment of the disclosure.

The method may include the following steps as shown in FIGS. 1-13. A retrieval line 15 is connected to the riser 34 using a ROV. Alternatively, the retrieval line 15 can be clamped directly to the riser 34 until the retrieval system 10 is needed (FIG. 1). The AHV 46 retrieves the first buoy 12 (FIG. 2) and the riser 34 is unlatched from the BOP 40 and moves away from the BOP 40 due to the flow of the current C (FIG. 3). The DP drilling vessel 44 moves to centralize the riser 34 in the moon pool/diverter housing of the drilling vessel 44 (FIG. 4). Alternatively, the moored vessel or the DP vessel 44 can remain stationary on top of the well, and the anchor handling vessel 46 can apply the needed tension to the retrieval line 15 to straighten the riser 34 in the moon pool. The tension application can be carried out by moving the AHV 46 away from the drilling vessel 44 while maintaining the length of the retrieval line 15, or by using the winches on the AHV 46 (pulling in the retrieval line 15) to increase the line tension as required (FIG. 5). The drilling vessel 44 starts to bring the riser 34 up to the water line 48 (FIG. 6). The weight of the chain portion 24 of the retrieval line 15 adds a horizontal force and vertical tension component to the connection as the riser 34 is raised into the moon pool. While the riser 34 is being pulled up to the water line 48, the anchor handling vessel 46 maintains tension on the riser 34, and centralizes the riser 34 in the diverter housing by applying a horizontal load that is opposite to the current load on the bottom end of the riser 34 (FIG. 7). Once the riser 34 has risen to a position near the bottom of the drilling vessel 44, the anchor handling vessel 46 moves closer to the drilling vessel 44 and the retrieval line 15 in order to release the tension on the riser 34 (FIG. 8). The riser 34 deflects to its stable position under the current loads which prevent shook loads on the riser 34 as the retrieval line 15 is disconnected. This causes the second buoy 36 to rise toward the water line 48. The retrieval line 15 connected to the riser 34 is remotely disconnected and the retrieval line 15 moves away from the drilling vessel 44 (FIGS. 9, 10). The retrieval line 15 may be disconnected by using an ROV or any other known disconnect system may be used. If needed, the drilling vessel 44 drifts a small distance with the current flow to straighten the riser 34 in the moon pool (FIG. 11) and the riser 34 and LMRP 38 are retrieved completely into the drilling vessel 44 (FIGS. 12, 13).

In the retrieval system, the applied bottom loads on the riser 34 are controlled by tension on the retrieval line 15 and the anchor handling vessel 46. The type of the wire of the retrieval system 10 is determined based on sea bed installation and required loads and the chain 24 can be replaced with an anchor or clump weight. The retrieval system 10 may be deployed away from the drilling vessel 44 in a safe zone. The anchor handling vessel 46 can be near to the drilling vessel 44 or drilling vessel 44 can move towards the retrieval system 10 with the riser 34 connected to the BOP stack 37 or connected to the LMRP 38 as required by the well operation. For both moored drilling units and DP drilling vessels 44, the retrieval system 10 may be connected to the riser 34 while it is connected to the BOP stack 37 at the seabed 14, or after the riser 34 is disconnected from the BOP 40 depending on subsea installations.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A method for retrieving a drilling riser connected to a blow-out-preventer (BOP) located on a sea bed using a retrieval line having first and second ends, wherein the drilling riser is connected to a moored drilling vessel or a dynamically-positioned drilling vessel, either having a bottom opening, the method comprising the steps of:

a) attaching the first end of the retrieval line to a second vessel;

b) attaching the second end of the retrieval line to the drilling riser;

c) disconnecting the riser from the BOP;

d) initiating the assent of the disconnected drilling riser from the sea bed;

e) the second vessel maintaining tension on the drilling riser as it ascends to the sea surface by creating a horizontal load that is opposite to a current load on a bottom end of the drilling riser;

f) the second vessel releasing tension on the retrieval line as the drilling riser approaches the bottom of the drilling vessel; and g) disconnecting the retrieval line from the drilling riser, whereby the drilling riser is pulled through the bottom opening in the drilling vessel.

2. The method of claim 1, wherein the drilling riser is disconnected from the BOP prior to attaching the second end of the retrieval line to the drilling riser.

3. The method of claim 1, wherein the drilling riser is disconnected from the BOP after attaching the second end of the retrieval line to the drilling riser.

4. The method of claim 1, wherein the retrieval line is disconnected from the drilling riser with a remote activated disconnect device.

5. The method of claim 1, wherein the retrieval line includes a first buoyant object connected to a first end of a wire, a second end of the wire connected to a first end of a weighted length of material, a second end of the weighted length of material connected to a first end of a rope, a second end of the rope configured to connect to the drilling riser, and a second buoyant object attached to a mid-point of the rope.

6. The method of claim 5, wherein the second vessel retrieves the first buoy floating on the surface of the sea while the drilling riser is still connected to the BOP.

7. The method of claim 1, wherein the drilling vessel is moved to straighten the drilling riser in the bottom of the drilling vessel prior to initiating the assent of the disconnected drilling from the sea bed.

8. The method of claim 1, wherein the second vessel attached to the first end of the retrieval line is moved to apply the needed tension to the retrieval line to straighten the drilling riser in the bottom opening of the drilling vessel.

9. A retrieval system for retrieving a drilling riser connected to a blow-out-preventer (BOP) located on a sea bed, wherein the drilling riser is connected to a moored drilling vessel or a dynamically-positioned drilling vessel, the retrieval system comprising:

a first buoyant object connected to a first end of a wire, a second end of the wire connected to a first end of a weighted length of material, a second end of the weighted length of material connected to a first end of a rope, a second end of the rope configured to connect to the drilling riser, and a second buoyant object attached to a mid-point of the rope;

wherein applied bottom loads on the retrieval system are controlled by line tension and a second vessel.

* * * * *